US007637351B2

(12) United States Patent
Langsmead

(10) Patent No.: US 7,637,351 B2
(45) Date of Patent: Dec. 29, 2009

(54) SCAFFOLD SAFETY APPARATUS

(76) Inventor: Roger Langsmead, 26 Park St., Saugus, MA (US) 01906

( * ) Notice: Subject to any disclaimer, the term of this patent is extended or adjusted under 35 U.S.C. 154(b) by 608 days.

(21) Appl. No.: 11/042,926

(22) Filed: Jan. 25, 2005

(65) Prior Publication Data

US 2006/0163002 A1 Jul. 27, 2006

(51) Int. Cl.
*E04G 5/00* (2006.01)

(52) U.S. Cl. ..... 182/113; 182/3

(58) Field of Classification Search ..... 182/3, 182/113

See application file for complete search history.

(56) References Cited

U.S. PATENT DOCUMENTS

| | | | | |
|---|---|---|---|---|
| 4,034,828 | A | 7/1977 | Rose et al. | |
| 4,130,176 | A | 12/1978 | Paulie | |
| 4,171,032 | A * | 10/1979 | Woolslayer et al. | 182/3 |
| 4,699,245 | A | 10/1987 | Benedet | |
| 5,388,661 | A * | 2/1995 | Hood, Jr. | 182/3 |
| 6,321,872 | B1 * | 11/2001 | Parker | 182/3 |
| 6,776,259 | B1 | 8/2004 | Murten | |
| 2002/0185335 | A1 | 12/2002 | Verdyk | |
| 2002/0189898 | A1 | 12/2002 | Campbell | |
| 2003/0047382 | A1 | 3/2003 | Panacci | |

FOREIGN PATENT DOCUMENTS

| | | | |
|---|---|---|---|
| DE | 3818176 | C2 | 3/1989 |
| EP | 0843 057 | B1 | 5/1998 |
| EP | 0881 339 | B1 | 12/1998 |
| EP | 1 267 014 | A1 | 12/2002 |
| GB | 2 369 853 | A | 11/2000 |
| GB | 2 357 112 | A | 6/2001 |
| GB | 2 357 542 | | 6/2001 |
| GB | 2 381 555 | A | 1/2002 |
| WO | WO 01/07730 | A1 | 2/2001 |
| WO | WO 01/44599 | A1 | 6/2001 |
| WO | WO 02/28482 | A1 | 4/2002 |

OTHER PUBLICATIONS

Spider, Safeworks, LLC, product guide, retrieved on Jan 11, 2005, URL: http://www.spiderstaging.com/safetysolutions.html.

Brand Services Inc, Scaffold Product Catalog, retrieved on Jan 11. 2005, URL:http://www.brandscaffold.com/Brand_catalog_MN_FNL.pdf.

Fisher, Harry, "Safety in Rigging and Scaffolding on Highway Bridges," 3 (3): 38-41 *Journal of Protective Coatings & Linings* (1986).

* cited by examiner

*Primary Examiner*—Katherine Mitchell
*Assistant Examiner*—Candace L. Bradford
(74) *Attorney, Agent, or Firm*—Antoinette G. Giugliano PC

(57) ABSTRACT

The present invention relates to scaffold safety apparatuses that allow a construction worker to safely tie-off while erecting a scaffold. The present invention allows the worker to move across one or more scaffold sections without having to disengage the safety line. In one embodiment, the safety apparatus (e.g. safety device or safety mount) includes two offset elongated members disposed in essentially parallel directions, wherein at least one of these two elongated members has a device that engages a safety line. The safety apparatus also has a connector that connects one elongated member to the other elongated member, and an attachment for securing at least one elongated member to the scaffold. The present invention additionally pertains to a scaffold safety system that includes one or more safety apparatuses, and a safety line; safety scaffolds, kits and methods for using same.

8 Claims, 8 Drawing Sheets

16
10A
15A
12
14A
15A
30B
14B
15B
D
30A
10B

SCAFFOLD SAFETY APPARATUS

BACKGROUND OF THE INVENTION

The U.S. Department of Labor sets out certain criteria to protect construction workers from falling off high area platforms, including scaffolds. For instance, the criteria require, in part, that the workers be tied-off while working on such platforms to prevent accidental falls. Various devices have been used to tie-off or secure workers, but many of them are not suitable for erecting or building a scaffold and often have several drawbacks.

For example, some safety devices restrict workers to a work area of one or two square meters which impede or slow down their ability to work efficiently and get the job completed quickly. Other safety devices prevent workers from moving between sections of scaffold because a lanyard, the cord that connects the harness to the safety device, often gets caught on the scaffold structure or the safety device itself. Hence, workers create a dangerous situation because, many times, they have to disconnect the lanyard from the safety device, move to the next section of scaffold, and reconnect to a safety device on this scaffold section. Workers can accidentally fall when moving between sections with such a device, or sometimes they forget to reconnect all together.

Hence, a need exists for a scaffold safety device that allows workers to build or erect a scaffold. A further need exists to allow workers to be tied-off, but provide a larger work area. Yet, another need exists for a scaffold safety device that does not require a worker to disconnect and/or reconnect to a safety device when moving between more than one scaffold section.

SUMMARY OF THE INVENTION

The present invention relates to a scaffold safety apparatus that allows one or more construction workers to safely tie-off when on a scaffold, while allowing the worker to move across one or more scaffold sections without having to disengage the safety line. In one embodiment, the safety apparatus (e.g., safety device or safety mount) includes two offset elongated members disposed in essentially parallel directions. At least one of these two elongated members has a device that engages a safety line (e.g., a cable clamp, a cable grab, a hook, or any combination thereof). The safety apparatus also has a connector that connects one elongated member to the other elongated member, and an attachment for securing at least one elongated member to the scaffold (e.g., a clamp, a clasp, a nut & bolt arrangement, a fastener, a grip, a vise, quick-release snap clamp, or any combination thereof). The connector connects, for instance, a top section of one elongated member to a bottom section of the other elongated member. The elongated members are offset by a distance in an amount to allow, when installed, a person to move across one or more scaffold sections, and for example, in an amount between about 1 inch (about 2.54 cm) and about 12 inches (about 30.5 cm). Another embodiment further includes having a safety line engaged to the device.

The present invention also is directed to a scaffold safety mount that includes a first elongated member having an attachment for securing the first elongated member to a scaffold, a second elongated member, disposed in a direction essentially parallel to that of the first elongated member. The mount also has a device for engaging a safety line, and a cross bar connecting the top section of the first elongated member to the bottom section of the second elongated member. The first elongated member has a length sufficient to have an attachment for securing the member to the scaffold, e.g., a length between about 2 feet (about 61 cm) and about 6 feet (about 183 cm). The second elongated member has a length sufficient to connect to the device for engaging the safety line, e.g., a length between about 2 feet (about 61 cm) and about 6 feet (about 183 cm). The cross bar has a length sufficient to connect the elongated members so that a person using the device, when installed, extends past the innermost portion of the scaffold, and allows one to move across more than one scaffold section without having to disengage, e.g., a length between about 1 inch (about 2.54 cm) and about 12 inches (about 30.5 cm).

The scaffold safety apparatus can be constructed from in a single piece, or from more than one piece. The apparatus of the present invention can also be made of a single type of material, different types of materials, blends of materials, or any combination thereof. In one embodiment, the elongated members and/or the cross bar can be made from a metal (e.g., steel, titanium, or any combination thereof), alloy, plastic, or any combination thereof.

The present invention additionally relates to a scaffold safety apparatus that includes two offset elongated members disposed in essentially parallel directions, at least one of the two elongated members having a hook for engaging a safety line; a connector that connects the bottom section of the first elongated member to the top section of the second elongated member; and a clamp for securing at least one elongated member to a scaffold.

The present invention also pertains to a safety scaffold system. The system includes more than one scaffold safety apparatus, as described herein, and a safety line engaged to the device (e.g., a hook). When the system is installed, the system allows a person to move across one or more scaffold sections without having to disengage the safety line. The safety line is positioned so that the line is secured to the device for engaging the safety line, double looped and secured (e.g., reattached). The safety line is attached to withstand a weight of between about 5000 lbs. (2267.96 kilograms) and about 20,000 lbs. (9,071.85 kilograms). The present invention further includes a harness system (e.g., a harness that is secured to the person, and a lanyard that connects the harness to the safety line) or body-belt system (e.g., a body belt that is secured to the person and lanyard that connects the body-belt to the safety line) for engaging a person to the safety line.

Another aspect of the present invention is a scaffold safety system that has a scaffold, a device for engaging a safety line, an attachment for securing the device to the scaffold; and a safety line engaged to the device. The safety line is threaded through the device for engaging the safety line, double looped, and reattached. The attachment for securing the device to the scaffold is positioned such that the safety line clears the innermost portion of the scaffold structure.

The methods of the present invention include methods for erecting or building a scaffold. The steps embody erecting or installing the first scaffold level and attaching the safety system, as described herein. The methods further include securing a person to the safety system, and installing a second scaffold level while secured to the safety system. These steps can be repeated to build or erect additional scaffold levels.

The present invention also relates to methods for a person to safely use a scaffold. The steps of the methods include, in one embodiment, engaging a person to a safety line of a safety scaffold system; engaging the safety line to the safety scaffold system, as described herein, and moving across one or more scaffold sections without disengaging the safety line. The method further includes a person engaging to the safety line with a lanyard hook, a lanyard and harness.

Yet another embodiment of the present invention relates to a safety scaffold structure that includes a scaffold (e.g., a frame and brace type scaffold, a cup lock type scaffold, a quick erect system scaffold, tube and clamp type system scaffold, a systems scaffold, or any combination thereof) having one or more scaffold sections; and the scaffold safety apparatus described herein.

The present invention also embodies a scaffold safety kit that has one or more scaffold safety apparatuses described herein and a safety line. The kit can additionally include a harness system or body-belt system.

One aspect of the present invention includes scaffold safety systems that contain a scaffold, more than one device for engaging a safety line; more than one attachment for securing the device to the scaffold; and a safety line engaged to the devices, wherein the safety line is double-looped. Another aspect of the invention pertains to a scaffold safety system that includes a scaffold railing; and a support secured to the scaffold railing. The support has a device for engaging a safety line past the inside portion of the scaffold railing and includes at least one elongated member.

Another embodiment of the present invention is a scaffold safety apparatus for use on a scaffold having a scaffold railing, wherein the apparatus has at least one elongated member having a device for engaging a safety line; and one or more attachments for securing at least one elongated member to the scaffold; wherein, when installed on the scaffold, one of the following occurs: the apparatus is positioned to extend past the inner portion of the scaffold railing; the apparatus is offset in an amount greater than a distance between an inner and outer scaffold railing; the apparatus is offset by a distance of between about 1 inch (about 2.54 cm) and about 12 inches (about 30.5 cm); the apparatus is angled by an amount between about 145 degrees and about 180 degrees from the point of attachment to the scaffold.

The present invention has several advantages. The scaffold safety apparatus of the present invention allows for one to be secured while erecting or building a scaffold. It also provides a larger, more accessible work space for the worker, while being tied off or secured. Additionally, the present invention allows one to move across more than one section of scaffold without having to disconnect and reconnect to the safety line, unlike some devices currently on the market. Hence, the present invention increases safety without minimizing productivity.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 1C-1 is a diagram showing another detailed view of the clamp attachment shown in FIG. 1B.

DETAILED DESCRIPTION OF THE INVENTION

A description of preferred embodiments of the invention follows.

The present invention relates to a scaffold safety apparatus (e.g., mount) that is constructed to allow a person (e.g., a construction worker) to be securely tied off to a safety line, but at the same time, allows the person to move across multiple sections of scaffold. The ability to move across multiple sections of scaffold more easily allows workers to build or erect a scaffold, or to work on a scaffold level more productively. In particular, the present invention includes an apparatus that has two elongated members that are positioned in parallel directions. These elongated members are offset, as further described herein, by a distance to clear the inside portion (e.g., innermost portion) of the scaffold structure, when installed on a scaffold. Another aspect of the invention involves the scaffold safety system that includes the safety apparatus and a safety line. The safety line is attached to the safety apparatus and doubled looped along the length of the scaffold sections, as further described herein. The design of the apparatus coupled with the double looped safety line provides for a system that allows a person to walk along multiple scaffold sections without having to disconnect and/or reconnect to the safety line.

Figure 1A:
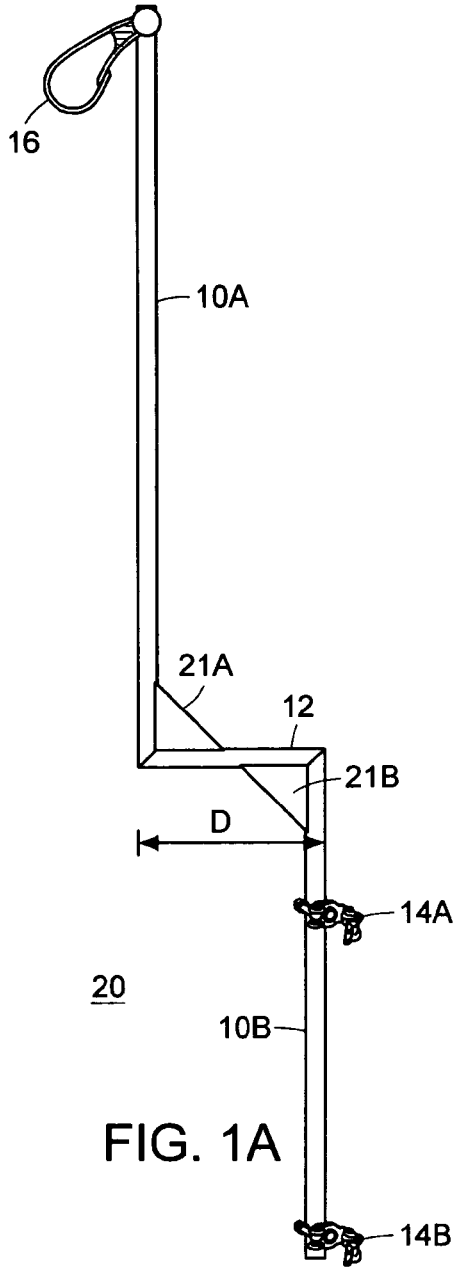
FIG. 1A is a diagram showing a side view of one embodiment of the scaffold safety apparatus.
Figure 1B:
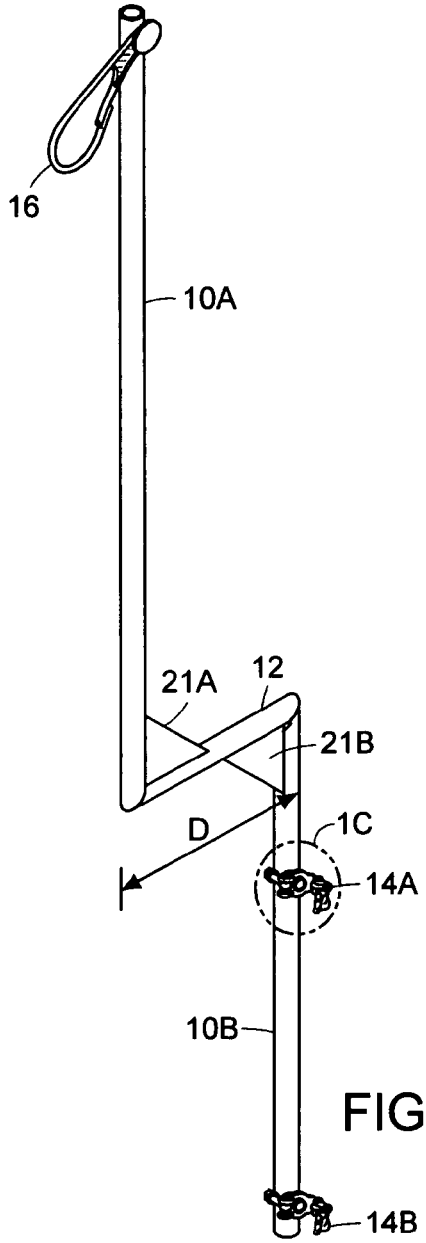
FIG. 1B is a diagram showing a perspective view of one embodiment of the scaffold safety apparatus.
Figure 1C:
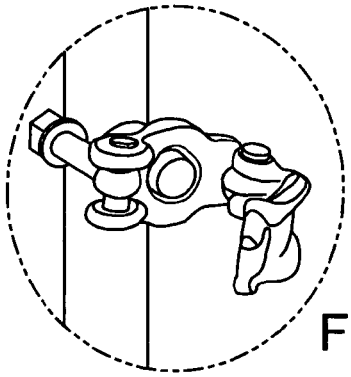
FIG. 1C is a diagram showing a detailed view of the clamp attachment shown FIG. 1B.
Figures 1, 1C:
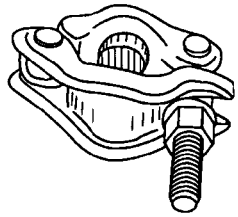

Referring to FIGS. 1A-C, scaffold safety apparatus 20 has elongated member 10A and elongated member 10B that are positioned in a parallel fashion, and secured with diagonal supports 21A and B. Generally, the members can be disposed in essentially parallel directions, meaning that the members may be parallel or, if not exactly parallel both are disposed in primarily the same direction (e.g., vertically). FIG. 1A is a side view of the apparatus, FIG. 1B is a perspective view of the same embodiment of the apparatus, and FIGS. 1C and 1C-1 show a detailed view of the clamp used to secure the apparatus to the scaffold railing. As shown in the diagram, elongated member 10A and member 10B are offset by distance D of a length sufficient to clear the inside portion of the scaffold railing. Elongated members have a length sufficient to allow for the-member to be secured to the scaffold with the attachment, e.g., a length between about 2 feet (about 61 cm) and about 6 feet (about 183 cm).

Although, in this embodiment, the elongated members are parallel, they can assume other positions so long as the device for engaging a safety line extends beyond the innermost portion of the scaffold railing on which it is installed. See FIGS. 1D-H below for examples. This positioning of the member allows for a person to walk freely along one or more scaffold sections when the person is secured to a safety line (e.g., a doubled looped safety line) that is engaged to the safety apparatus.

Members 10A and 10B are connected by cross bar 14, as seen in FIGS. 1A-B. Cross bar 14 connects the bottom portion of one elongated member, e.g., member 10A, with the top portion of another elongated member, e.g., member 10B. In addition to cross bar 14, other connecting means can be employed to attach members 10A and 10B so long as they are positioned as described herein. Examples include, e.g., screws, diagonally positioned bars, "X" type attachments, cross type attachments, and others. Any connectors or attachments can be used, including those that are developed in the future, so long as the device for engaging the safety line is secured and positioned as described herein. Such connectors are known in the art, and are commercially available from, e.g., Harding Co. (Exeter, N.H.), or Colony Co. (New Haven, Conn.). The connection can be permanent, e.g., welded, or can be reversibly attached, e.g., with clamps or screws. Elongated members are offset by a distance sufficient to place elongated member 10A in a position to clear the inside portion of the scaffold railing on which the apparatus is installed. The offset amount also depends on the design of the scaffold and the position of the inside railing. For example, for several of the existing scaffolds, offsetting the elongated members by a distance in an amount between about 1 inch (about 2.54 cm) and about 12 inches (about 30.5 cm) generally extends the device for engaging the safety line past the inside portion of the scaffold railing.

The apparatus, including the elongated members and/or the connector, can be made from several types of materials including metal, an alloy, plastic, any other suitable material, or combinations thereof. Any type of material can be used so long as the material has the strength to withstand the force of an accidental fall of a person using the device. Examples of such materials include steel, titanium, or a combination thereof.

FIGS. 1A and 1B also show hook 16. Hook 16 is mounted to elongated member 10A. When installed on a scaffold, hook 16 extends past the inside railing of the scaffold on which the apparatus is installed. Hook 16 is used to engage a safety line. Examples of other devices that can be employed for engaging a safety line include cable clamps, cable grabs, hooks, catches or combinations thereof. Examples of various types of hooks can be used and include a form hook, a locking snap hook (e.g., U.S. Pat. Nos. 4,527,728 and 4,434,536), a double lock hook, a ladder hook, and a twist & lock hook. Any device known in the art or developed in the future can be used so long as the device can securely engage a safety line. Such devices are commercially available and can be obtained, e.g., from Spider®, a division of SafeWorks, LLC (Tukwila, Wash.), or Rose Manufacturing company (Englewood, Colo.).

Clamps 14A and 14B, referring to FIGS 1A-C, are attachments for securing member 10B to the scaffold. The attachment of the safety device can be permanently welded, or reversibly attached to the scaffold. One or more attachments for securing the safety apparatus to the scaffold can be used and can be attached to any portion of the apparatus. The attachments can be connected to a vertical member of the scaffold, a horizontal member of the scaffold or to a locking mechanism of the scaffold (e.g., a cup lock type scaffold). Attachments include, for example, clamps, clasps, nut & bolt arrangements, fasteners, grips, vises, quick-release snap clamp, and any combination thereof. Examples of clamps that can be used include beam clamps, right angle clamps, T-bolt clamps, eye-bolt clamps and swivel clamps. Such attachments are commercially available and can be obtained from, Safway Services, Inc. (Waukesha, Wis.); Harding co (Exeter, N.H.) and Edge International (Laguna Niguel, Calif.). Any attachment, including those that are known and those developed in the future, can be used so long as the safety device is securely attached to the scaffold.

Apparatus 20 can be installed on many types of scaffold including, for example, frame and brace type scaffolds, cup lock type scaffolds, quick erect system scaffolds, tube and clamp system scaffolds, systems scaffolds, or any combination thereof, as further described herein. Embodiments of the present invention, such as apparatus 20, universally fits and can be used all of the five types of scaffold listed above.

In one embodiment, the apparatus can be interwoven into the structure of the scaffold. Generally, scaffolds have levels that are connected or interlocked. They can be connected in various ways, such as using male and female ends (e.g., frame and brace type scaffold), or locking mechanisms (e.g., a cup lock type scaffold). The apparatus can have an attachment that takes advantage of the method for interlocking levels of the scaffold. For example, the apparatus can have a male or female end that is inserted into or received by a vertical or horizontal post of a scaffold, or have an extension that locks into the cup-locking mechanism.

Figures 1D, 1E, 1F, 1G, 1H:
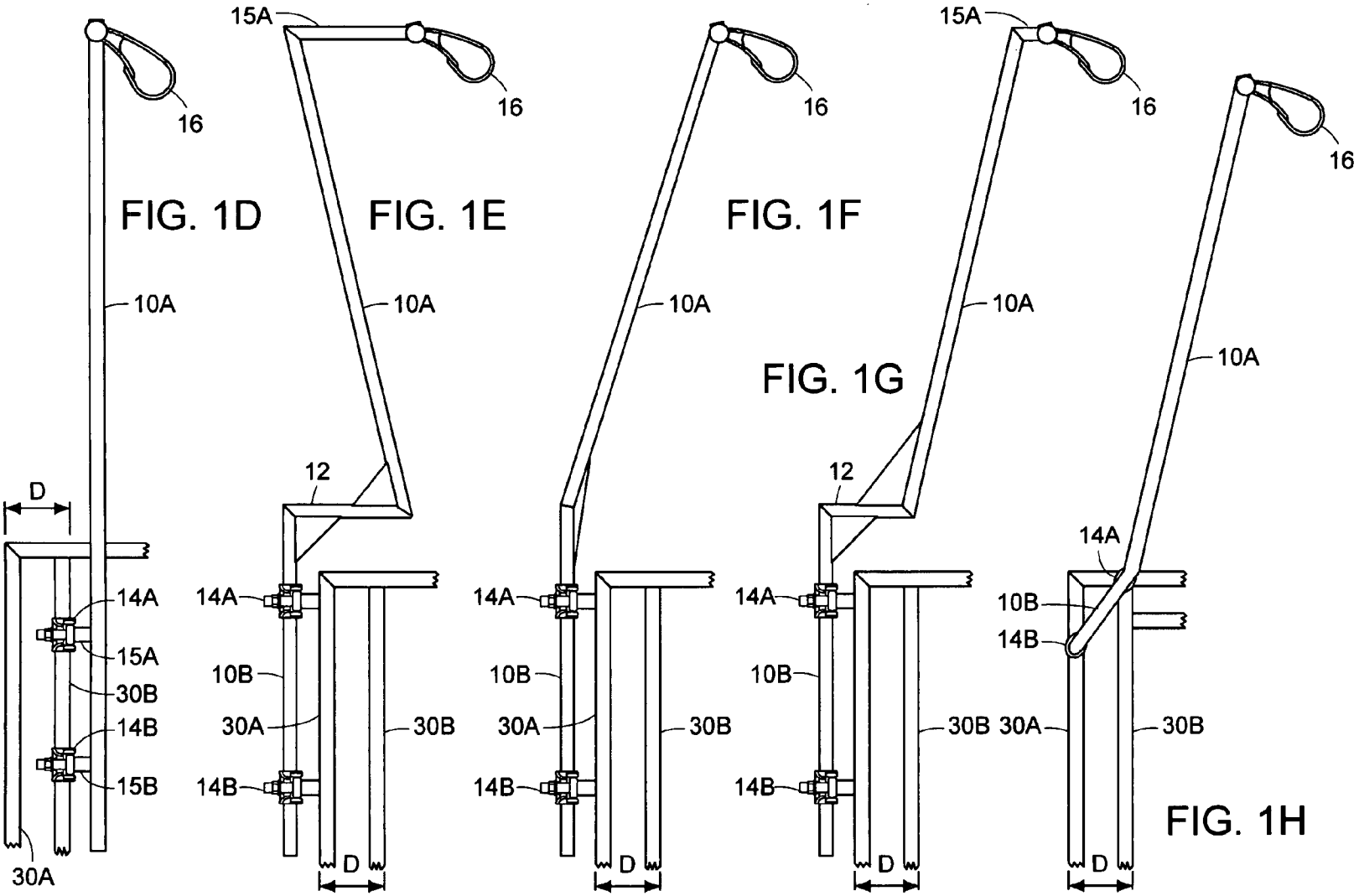
FIG. 1D is a diagram showing a side view of one embodiment of the scaffold safety apparatus.
FIG. 1E is a diagram showing a side view of another embodiment of the scaffold safety apparatus.
FIG. 1F is a diagram showing a side view of another embodiment of the scaffold safety apparatus.
FIG. 1G is a diagram showing a side view of another embodiment of the scaffold safety apparatus.
FIG. 1H is a diagram showing a side view of another embodiment of the scaffold safety apparatus.

Additional embodiments of the safety apparatus are shown in FIGS. 1D-1H. These embodiments of the safety apparatus illustrate that the device can be designed in various ways so long as the device for engaging the safety line, if installed on a scaffold, would extend past the inner portion of the scaffold railing. This positioning past the inner portion of the scaffold railing can be further described by the angle of the device in relation to its base or point of attachment to the scaffold, or even its relationship to the scaffold railing. The positioning of the device for engaging the safety line can also be described by a distance by which the device extends from its base or scaffold railing. For example, an embodiment of the invention includes a support having a base for attachment to the scaffold and device for engaging a safety line. The support extends so as to put the device in a position past the inner portion of the scaffold railing. In the embodiment described in FIGS. 1A-C, this position accomplished by cross bar 12 that offsets elongated member 10A by an amount between about 1 inch (about 2.54 cm) and about 12 inches (about 30.5 cm) (e.g., 11 inches). Using the same embodiment, the position of the device for engaging the safety line is at an angle between about 145 degrees and about 180 degrees (e.g., 157 degrees) with respect to elongated member 10B's point of attachment (e.g., the base or the support). FIG. 1D shows an embodiment of the apparatus having only one elongated member, elongated member 10A. Clamps 14A and B are connected to elongated member 10A with extension bars 15A and B. Extension bars 15A and B offset hook 16 so that hook 16 extends past the scaffold railing when installed. Similarly, FIG. 1E shows an embodiment of the present invention in which hook 16 is properly positioned with extension bar 15A and an angled elongated member 10A, which forms an inverted "Z" shape. In FIG. 1F, elongated members 10A and 10B are directly attached without use of a cross bar, but hook 16 is properly positioned to be past the scaffold railing by an angled elongated member 10A. Additionally, FIG. 1G shows yet another embodiment that is similar to the apparatus of FIG. 1A, but has a shorter cross bar and an angled elongated member 10A. Lastly, FIG. 1H shows an example of the apparatus in which member 10B is angled to offset Distance D and clamped to railings 30A and B of a frame and brace type scaffold with clamps 14A and B. Member 10A is the extended in a vertical direction, on which hook 16 is mounted. Other embodiments can also be used with the present invention, so long as one of the following occurs: a) the apparatus extends past the inner portion of the scaffold railing; b) the apparatus is offset in an amount greater than Distance D, c) the apparatus is offset by a distance of between about 1 inch (about 2.54 cm) and about 12 inches (about 30.5 cm); or c) the apparatus is angled by an amount between about 145 degrees and about 180 degrees in relation to its base or point of attachment to the scaffold.

Hence, simply put, the present invention involves having at least one elongated member having a device for engaging the safety line, and at least one attachment for securing the elongated member to the scaffold, such that the device, when installed on the scaffold, extends past the innermost portion of the scaffold railing. FIGS. 1D-1H simply illustrate various designs to secure the apparatus to the scaffold and, at the same time, properly position the device for engaging the safety line, as described herein.

Figure 2A:
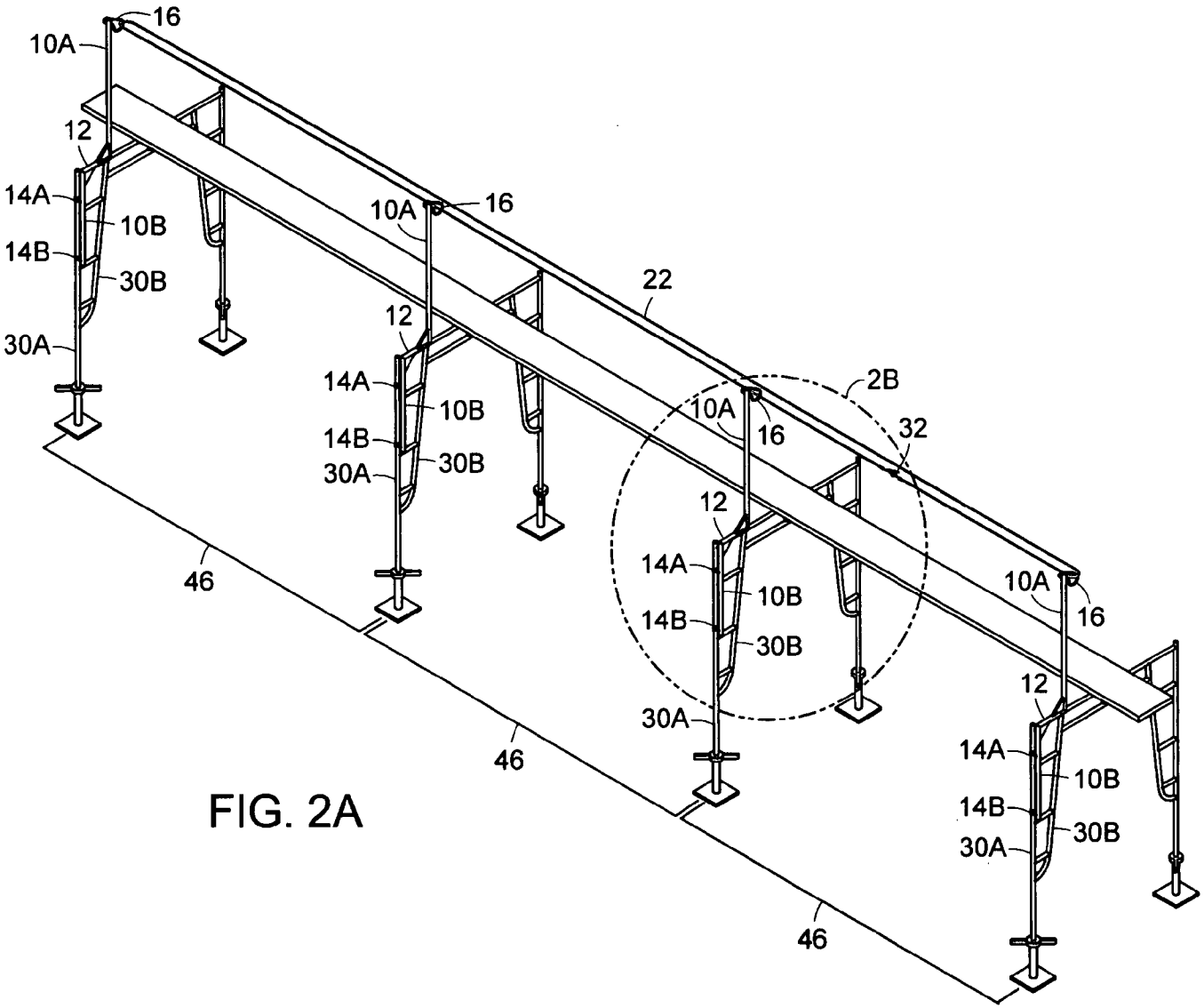
FIG. 2A is a diagram showing a perspective view of one embodiment of the scaffold safety system.
Figure 2B:
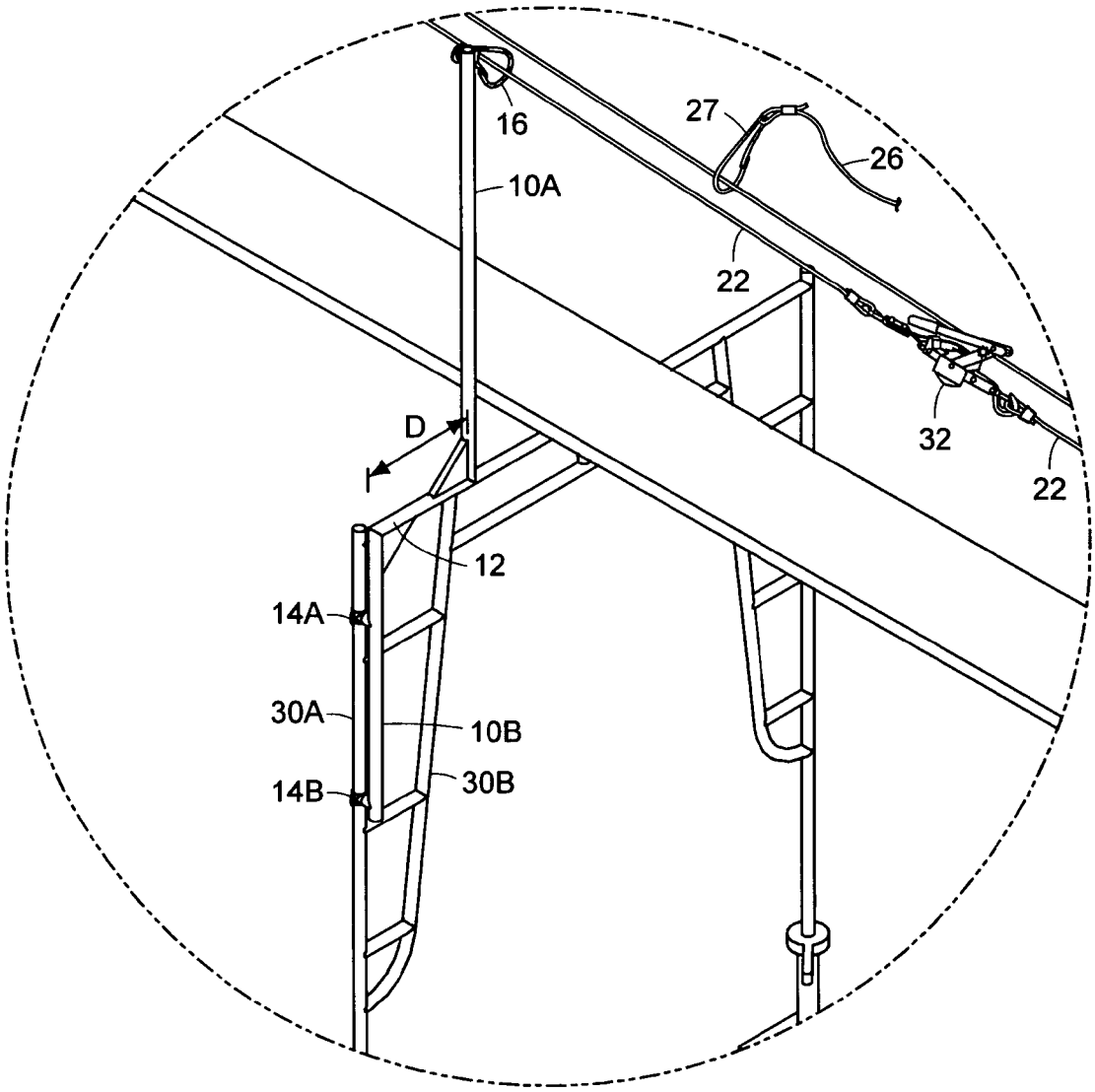
FIG. 2B is a diagram showing a detailed view of the installed safety apparatus of FIG. 2A.

One embodiment of the safety scaffold system is shown in FIGS. 2A and 2B. Although a set of four scaffold safety apparatuses 20 of FIG. 1A-C is used in this instance, more or less safety apparatuses can be used to accomplish the task of securing an individual on a scaffold and allowing the individual to walk across more than one scaffold section 46 without having to disengage. In FIGS. 2A and B, elongated member 10B of each apparatus is secured to scaffold railing 30A by clamp 14A and B. Hook 16 is positioned past inside scaffold railing 30B. Safety line 22 is treaded through hook 16 of each apparatus 20, and then double looped, or looped around and secured to winch 32. Generally, the safety line should be tightened to withstand a force of an accidental fall of at least one person, e.g., in an amount between about 5000 lbs. (2267.96 kilograms) and about 20,000 lbs. (9,071.85 kilograms). This can be accomplished by methods known in the art for securely attaching two ends of a cable or safety line, including, for example, using a come-a-long, or a winch (e.g., manual or electronic) to tighten the line. To assist on in tightening the safety line, the ends of the safety lines can be looped and hooked on to the come-a-long or winch device, and then secured. After the safety line is double-looped, it can be reattached to itself, secured with a device, attached to the safety apparatus or to the scaffold. Attaching the ends of the line can be accomplished with a cable attachment (e.g., a cable vice, a cable clamp, a cable grip). The line can be looped around the hook (e.g., device for engaging the safety line), or with a pulley or cable block, similar to a clothes drying line. This double looping allows a person to secure oneself to the safety line 22 with lanyard 26 via lanyard hook 27. As the person moves about the scaffold, lanyard hook 27 avoids elongated member 10A and hook 16 thereby allowing the person to move freely.

Figure 3A:
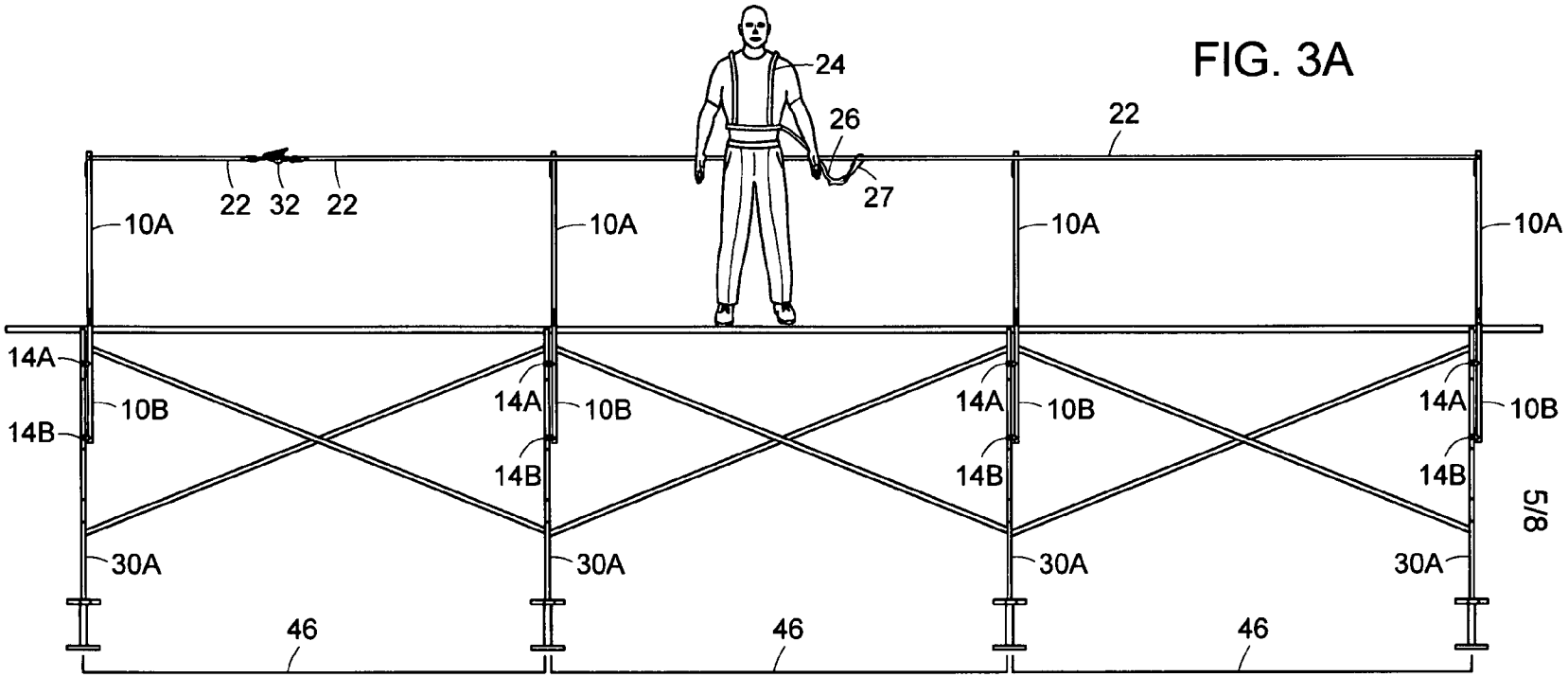
FIG. 3A is a diagram showing a front view of an embodiment of the scaffold safety system as installed on a Frame & Brace Type scaffold.
Figure 3C:
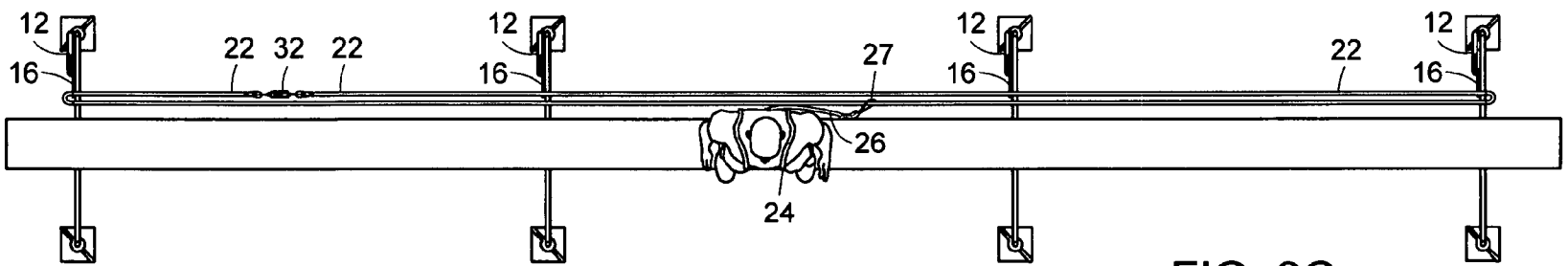
FIG. 3C is a diagram showing a bird's eye view of one embodiment of the scaffold safety system as installed on a Frame & Brace Type scaffold.
Figure 3B:
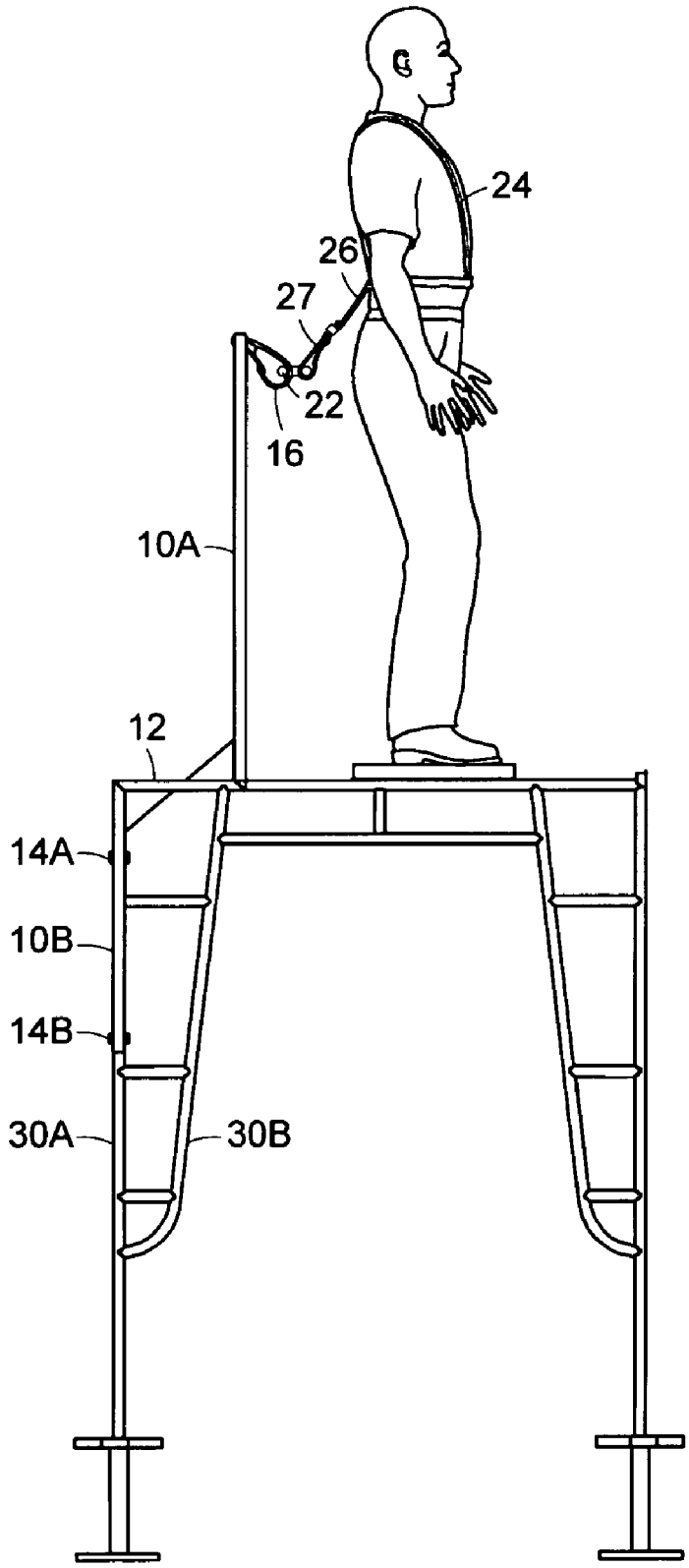
FIG. 3B is a diagram showing a side view of one embodiment of the scaffold safety system as installed on a Frame & Brace Type scaffold.

FIGS. 3A-C show the present invention, as installed on a frame and brace type scaffold. In the front view, shown in FIG. 3A, safety scaffold apparatus 20 is installed at the beginning and/or end of each scaffold section 46. Apparatus 20 is clamped to scaffold railing 30A with clamps 14A and B on the lower level of the scaffold. Hook 16 engages safety line 22, above the level to which member 10B is attached. More clearly seen in the side view, FIG. 3B, member 10A extends past the inner scaffold railing 30B. In this figure, the scaffold railing is shown in the level below the level on which the safety line is being used. The present invention can be installed on the upper most level of a scaffold, a lower level of a scaffold, or any level in between. Since the system's design involves having a safety line installed on the inside of the innermost portion of the scaffold railing, e.g., inner scaffold railing 30B, then the present invention can be used while stacking another scaffold level, or simply working on any level, including a mid-level or lower-level.

In particular, the present invention involves methods for safely erecting a scaffold. The steps of the method include erecting a first (e.g., ground) scaffold level, securing the safety system of the present invention to the erected scaffold level, securing one or more persons to the safety line of the safety system (e.g., engaging the lanyard to the safety line), and erecting a second scaffold level while engaged to the safety line. The method can further include repeating these steps to erect additional levels of scaffolds. After installing the next scaffold level, the person can remain tied off e.g., to the safety system on the current level, while installing a second safety system next level, and so on.

The bird's eye view, FIG. 3C, of the safety system shows a person wearing harness 24 and connected to safety line 22 with lanyard 26. Safety line 22 is threaded through hook 16 of each apparatus and doubled looped. The ends of safety line 22 are tightened to withstand the force of an accidental fall, and reattached with winch 32. This double looping of the safety line allows a person to move across more than one scaffold section 46 without having to disengage.

Several types of devices can be used to secure a person to the safety line so long as the person is safely tied off to the safety line. Harness systems or body-belt systems can be used. A harness system, referred to herein, refers to a harness and lanyard configuration, and a body-belt system includes a body-belt and lanyard. Similarly, many types of lanyards exist and can be used with the present invention to engage the safety line, and several devices, such as lanyard hooks, exist to attach the lanyard to the safety line. Harnesses, body-belts, and lanyards are known in the art and are commercially available for use with the present invention. Additionally, harnesses, body-belts, lanyards and similar systems that are developed in the future can be used as well.

A safety line can be made of cable, rope or other suitable material. The safety line can be of various gauges, thicknesses and/or lengths so long as the line has a sufficient gauge to withstand the force of an accidental fall of one or more persons, and so long the line has a length sufficient to be double looped, as described herein. The force of an accidental fall is measured by tests known in the art. The weight that the apparatus can withstand ranges from about 5000 lbs. (2267.96 kilograms) and about 20,000 lbs. (9,071.85 kilograms). The length of the safety line depends on the number of apparatuses used in the system and the distance they are spaced apart. Safety lines that known in the art or those later developed can be used. Safety lines can be obtained from a number of manufacturers, including, e.g., from Spider®, a division of SafeWorks, LLC (Tukwila, Wash.).

Figure 4A:
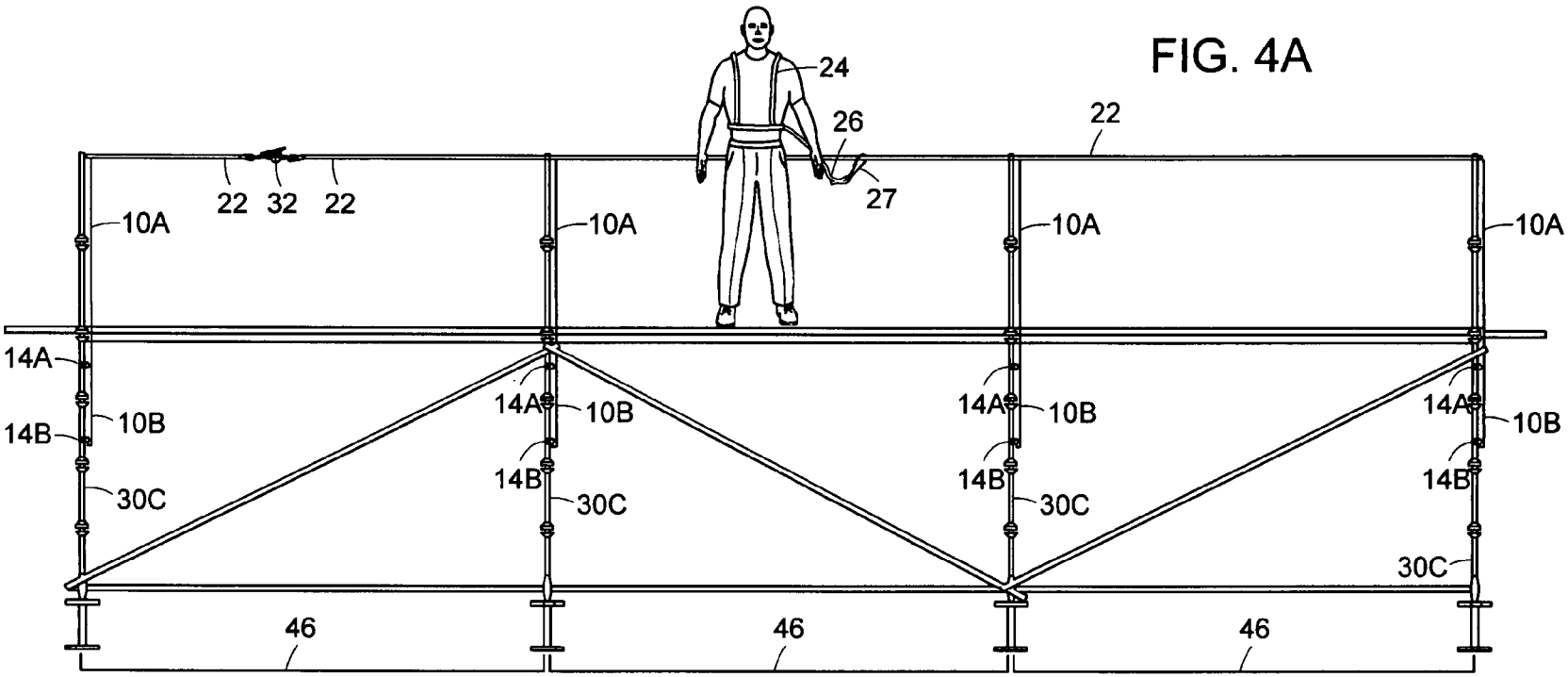
FIG. 4A is a diagram showing a front view of an embodiment of the scaffold safety system as installed on a Cup-Lock Type scaffold.
Figure 4C:
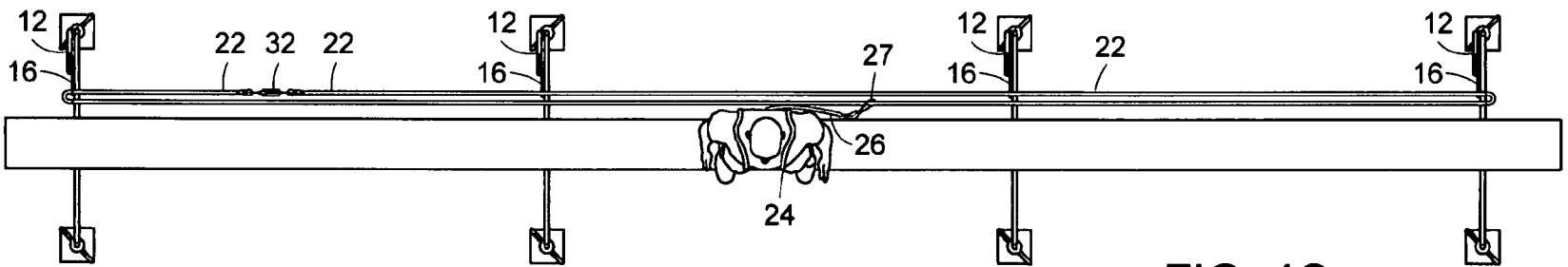
FIG. 4C is a diagram showing a bird's eye view of one embodiment of the scaffold safety system as installed on a Cup-Lock Type scaffold.
Figure 4B:
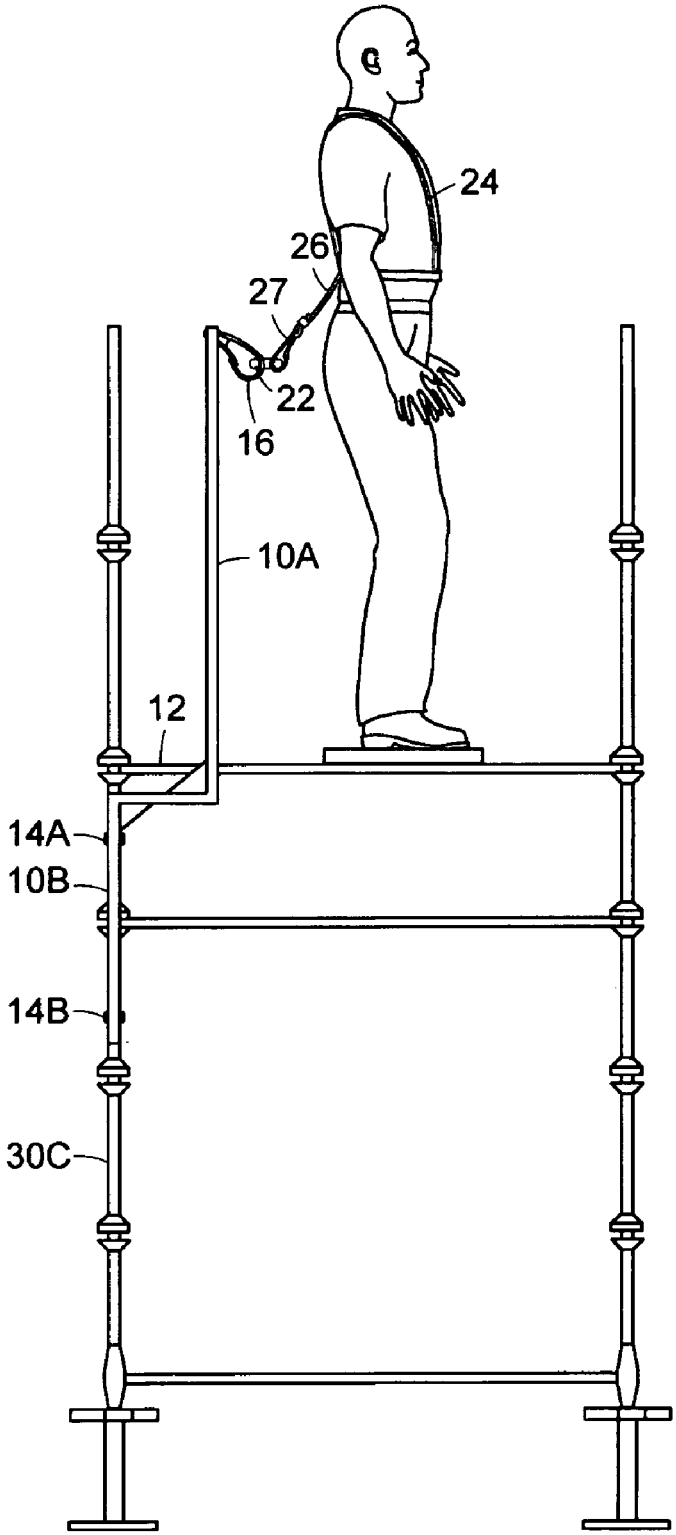
FIG. 4B is a diagram showing a side view of one embodiment of the scaffold safety system as installed on a Cup-Lock Type scaffold.

FIGS. 4A-4C show the safety scaffold system installed on a cup-lock type scaffold. The safety scaffold system of present invention is not limited to a particular type of scaffold, and can be installed on many types of scaffold including, for example, frame and brace type scaffolds, cup lock type scaffolds, quick erect system scaffolds, tube and clamp system scaffolds, systems scaffolds, or any combination thereof. Scaffolds are known in the art and can be obtained from a number of manufacturers including, e.g., Vanguard manufacturing Inc. (New Ipswich, N.H.), or Edge International (Laguna Niguel, Calif.). The present invention can be installed on scaffolds that are known in the art, or those later developed. The cup lock type scaffold uses a locking mechanism to secure the ends of vertical and horizontal members of a scaffold, as shown, e.g., in U.S. Pat. No. 5,560,730. Some scaffolds, including the cup lock type scaffold, do not have both outer and inner scaffold railings 30A and 30B, as shown with the frame and brace type scaffold in FIG. 3B, but has a single scaffold railing at this position, such as scaffold railing 30C, shown in FIGS. 4A and B. As referenced herein, when describing the position of the device for engaging the safety line as being past the inner most portion of the scaffold railing, in this case, refers to extending past the scaffold railing 30C. When referring to a scaffold having a double railing (e.g., an outer and inner railing as in scaffold railing 30A and 30B in the frame and brace type scaffold shown in FIGS. 3A-C), the position of the device for engaging the safety line extends beyond the innermost portion of the vertical railing, namely past scaffold railing 30B. Generally, the device for engaging the safety line extends past the inner portion of the scaffold structure so that the line can be positioned to allow one to walk freely along more than one scaffold sections. Safety scaffold apparatus 20 is secured with clamps 14A and B to scaffold railing 30C to be below the scaffold level, and member 10A is positioned to be above the scaffold level. FIG. 4C shows that hooks 16 of each apparatus 20 is positioned past scaffold railing 30C, as described herein, and the safety line is secured and double looped, also as further described herein.

FIGS. 3A-C and 4A-C illustrate that the present invention can be installed and used on various types of scaffolds, and is not limited to the particular scaffold being used.

Another embodiment of the present invention is a scaffold structure having the safety features of the present invention. For example, a type of scaffold can have a member that integrates with the scaffold system, and also has the elements of the present invention (e.g., more than one device for engaging a safety line, a safety line that is engaged to the device and double looped, and an attachment to secure the device to the scaffold). A vertical member of a scaffold can have an elongated member that simply extends past the inner most portion of the scaffold railing, and a device for engaging a safety line can be attached to the end of the elongated member. The safety line can be treaded through the device, e.g., a hook and then double looped as described herein. Similarly, the present invention embodies scaffold accessories, e.g., as shown for the cup lock system, that has a member having an end that interlocks with the scaffold system. The other end of the member can have, e.g., the device for engaging the safety line that extends beyond the innermost portion of the scaffold and the safety line can then be installed in accordance with the present invention.

The present invention also includes methods for safely using a scaffold. The steps of the method include engaging a person to the safety line of the safety scaffold system, and moving across one or more scaffold sections without disengaging the safety line. To engage a person to the safety line, in one embodiment, one can put on a harness and attach a lanyard to it. The hook on a lanyard can engage the outer portion of the double looped safety line of the safety scaffold system of the present invention.

EXEMPLIFICATION

Example 1

Construction of the Safety Scaffold Apparatus

The apparatus shown in FIG. 1A-C was constructed from two elongated members and a cross bar. These parts were welded together so that the elongated members were essentially parallel. One elongated member has a device for securing a safety line, namely a hook, and the other elongated member has an attachment for securing the safety device to the scaffold, namely two clamps. The elongated members and cross bar were reinforced with diagonal supports. The elongated member having the hook measures about 34 inches, and the elongated member having the clamps is about 32 inches in length. One clamp is positioned about 6 inches from the top of the elongated member, and the other clamp is positioned about 28 inches from the top of the same elongated member. The cross bar is approximately 11 inches in length. The elongated members and cross bar have a diameter of about 1⅝th inches, and are made from steel. The hook, which is about 4 inches in length and 2 inches in width, was attached with a swivel attachment, and the clamps were attached with bolts. The hook was purchased from Spider®, a division of SafeWorks, LLC (Tukwila, Wash.) (model no. 701283-1) and is further described by U.S. Pat. Nos. 4,528,728 and 4,434,536. The clamps were obtained from Safway Services, Inc. (Waukesha, Wis.) (model no. CRAL2).

Example 2

Use of the Safety Scaffold Apparatus on a Frame & Brace Type Scaffold

A series of four apparatuses, constructed as described in Example 1, were installed on a tube and clamp type scaffold (Lynn-Lad Group, LTD. (Lynn, Mass.)). Once the ground level of the scaffold was set-up, each of the apparatuses was clamped to a vertical member of the scaffold, and positioned so that the elongated member having the hook was placed above the scaffold level to which the apparatus was clamped. The hook attached to the elongated member extended past the innermost portion of the scaffold railing underneath, which in this case was the inner railing of the tube and clamp system. The safety line was threaded through each hook and double looped and reattached to itself. The line was tightened and the ends of the line were held in place using a come-a-long device. A person, having a harness and lanyard, then engaged the lanyard hook to the safety line. The person then proceeded to attach the next scaffold level and install all the vertical and horizontal members of the next scaffold level without having to disengage and/or re-engage the safety line. The person repeated these steps to erect a multi-level scaffold.

Example 3

Use of the Safety Scaffold Apparatus on a Cup Lock Type Scaffold

A series of four apparatuses, constructed in Example 1, were installed on a cup lock type scaffold (Lynn-Lad Group, LTD. (Lynn, Mass.)). Once the ground level of the scaffold was set-up, each of the apparatuses was clamped to a vertical member of the scaffold, and positioned so that the elongated member having the hook was placed above the scaffold level to which the apparatus was clamped. The cup lock type scaffold does not have a double scaffold railing; rather, it has a single vertical member at each support. Hence, the hook attached to the elongated member extended past the single vertical scaffold railing underneath. The safety line was threaded through each hook and double looped. The line was tightened and secured using a come-a-long device. A person, having a harness and lanyard, then engaged the lanyard hook to the safety line. The person then proceeded to attach the next scaffold level and install the vertical and horizontal members of the next scaffold level without having to disengage and/or re-engage the safety line. The person repeated these steps to erect a multi-level scaffold.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A safety scaffold system, wherein the system comprises:

a. two or more scaffold safety apparatuses, said apparatus that comprises:

i. a first elongated member;

ii. a second elongated member; and iii. a connector that connects a bottom section of the first elongated member to a top section of the second elongated member;

wherein at least one of the first and second elongated members includes an attachment for securing the apparatus to a scaffold and at least one of the first and second elongated member includes a device for engaging a looped safety line; and b. a single safety line forming a continuous loop engaged to said device, wherein the safety line withstands a weight of between about 5000 pounds and about 20,000 pounds and is suspended along the two or more scaffold safety apparatuses at the device for engaging the looped safety line.

2. The safety scaffold system of claim 1, wherein, when the system is installed, the system allow a person to move across one or more scaffold sections without having to disengage the safety line.

3. The scaffold safety system of claim 1, further including a harness system or body-belt system for engaging a person to the safety line.

4. The scaffold safety system of claim 3, wherein the harness system includes a harness that is secured to the person, and a lanyard that connects the harness to the safety line; and the body-belt system for engaging a person to the safety line includes a body belt that is secured to the person and lanyard that connects the body-belt to the safety line.

5. A method for a person to safely use a scaffold, wherein the method comprises:

a. engaging a person to a single safety line forming a continuous loop of a safety scaffold system;

b. engaging the looped safety line to the safety scaffold system, wherein the scaffold safety system comprises:

i. two or more scaffold safety apparatuses, said apparatus that comprises:

(1) a first elongated member;

(2) a second elongated member; and (3) a connector that connects a bottom section of the first elongated member to a top section of the second elongated member;

wherein at least one of the first and second elongated members includes an attachment for securing the apparatus to a scaffold and at least one of the first and second elongated member includes a device for engaging the looped safety line; and ii. the looped safety line engaged to said device, wherein the looped safety line withstands a weight of between about 5000 pounds and about 20,000 pounds and is suspended along the two or more scaffold safety apparatuses at the device for engaging the looped safety line,; and c. moving across one or more scaffold sections without disengaging the safety line.

6. The method of claim 5, wherein the person is engaged to the safety line with a lanyard and harness.

7. A safety scaffold structure, wherein the scaffold comprises:

a. a scaffold having one or more scaffold sections;

b. two or more scaffold safety apparatuses, wherein the apparatus comprises:

i. two offset elongated members disposed in essentially parallel directions, at least one of the two elongated members having a device for engaging a single safety line forming a continuous loop;

ii. a connector that connects one elongated member to the other elongated member; and iii. an attachment for securing at least one elongated member to a scaffold, wherein the elongated members, the connector or both are made from a material that includes metal, alloy, plastic, or any combination thereof; and c. the looped safety line engaged to said device, wherein the safety line withstands a weight of between about 5000 pounds and about 20,000 pounds and is suspended along the two or more scaffold safety apparatuses at the device for engaging the looped safety line.

8. The scaffold of claim 7, wherein the scaffold included either a frame and brace type scaffold, a cup lock scaffold, a quick erect system scaffold, tube and clamp system scaffold, a systems scaffold, or any combination thereof.

* * * * *